United States Patent [19]

Gasparoli

[11] 3,930,367

[45] Jan. 6, 1976

[54] FLUID FLOW CONTROL SYSTEM

[75] Inventor: Robert E. Gasparoli, Roanoke, Va.

[73] Assignee: General Electric Company, Salem, Va.

[22] Filed: Oct. 23, 1974

[21] Appl. No.: 517,259

[52] U.S. Cl. ..... 60/39.18 B; 60/664; 60/676; 290/4

[51] Int. Cl.[2] ..... F01K 23/10

[58] Field of Search ..... 60/660–667, 60/676, 39.18 B; 290/4, 40

[56] References Cited

UNITED STATES PATENTS 3,837,167 9/1974 Durrant et al. ..... 60/664

*Primary Examiner*—Allen M. Ostrager

*Attorney, Agent, or Firm*—Robert E. Brunson; Arnold E. Renner

[57] ABSTRACT

In a turbine powered generating system the rate of fuel flow for auxiliary firing of a steam turbine is automatically controlled to control the generation of steam for the turbine in accordance with turbine operating parameters and system power demands. Fuel flow rates are controlled within program selected limits to minimize stresses on the steam turbine, thus increasing the performance and life expectancy of the turbine.

14 Claims, 3 Drawing Figures

FLUID FLOW CONTROL SYSTEM

BACKGROUND OF THE INVENTION

This invention relates generally to fluid flow control systems of general use and more particularly to fluid flow control systems and apparatus of the type for controlling the rate of fuel flow for auxiliary firing of a steam turbine boiler.

FIELD OF THE INVENTION

In the field of turbine powered generating systems, the temperature of hot exhaust gasses from a gas turbine are sometimes utilized to heat the evaporator coils of a steam turbine boiler to make steam for powering the steam turbine. The temperature of these hot exhaust gasses is also frequently supplemented by heat from auxiliary firing means, such as a burner, to more effectively control the generation of the steam for powering the turbine.

DESCRIPTION OF THE PRIOR ART

For economic reasons, power generating stations frequently employ gas and steam turbines, each including a generator for supplying power to an electrical load. Hot exhaust gasses from the gas turbine, which would normally be wasted to the atmosphere, are utilized to provide heat for the steam turbine boiler. Generally, these hot gasses are exhausted into a heat chamber or manifold frequently referred to as a "waste heat recovery steam generator". Two major elements which are disposed in this chamber are an auxiliary firing means or burner and the steam turbine boiler evaporator coils. Water from the boiler is recirculated through the evaporator coils, heated by the hot exhaust gasses and returned to the boiler as steam. The auxiliary firing means receives fuel for burning in the chamber to more rapidly effect heating of the evaporator coils than that normally possible with increases in the temperature of the gas turbine exhaust gasses. It is well known in the art that a gas turbine does not respond instantaneously to increases and decreases in fuel supplied thereto. Thus, the temperature of the gas turbine exhaust does not change instantaneously. Further the gas turbine might be running at its maximum capacity and cannot provide sufficient heat for the steam turbine demands. Thus, the auxiliary firing means fulfills the needed demand increase.

To the best of this inventor's knowledge the rate of fuel flow provided to the auxiliary burners of steam trubines has always been under manual or semi-automatic control of a turbine operator. The operator by reading various gages used to monitor the power generating system, such as load requirements and steam turbine temperatures, determines how much he should open a valve to regulate the fuel flow to the auxiliary burner. By so doing he manually controls the amount of steam being generated to power the steam turbine, thus controlling the power output of the steam turbine generator.

It is also well known in the art that steam turbines are subjected to severe stresses (e.g. mechanical, thermal, vibration, etc.) when they must load, unload, accelerate, or decelerate too rapidly. At the best, these stresses can greatly reduce turbine life and if they become too severe can cause catastrophic turbine failure. It has been found that operator manual control of the auxiliary firing is an adverse condition because it does not allow optimization of these turbine stresses (e.g. under cold, warm and hot conditions) to keep them at a minimum. This is because the rate at which steam is provided to the turbine is a direct factor of operator experience.

In view of these adversities it is desirable to provide a system and apparatus for automatically controlling the fuel flow rate for auxiliary firing of a steam turbine under all turbine operating conditions whereby the turbine stresses are minimized, thus resulting in increased performance and sustained turbine life.

SUMMARY OF THE INVENTION

In accordance with the present invention a combination gas and steam turbine powered generating system is provided for supplying regulated power to an electrical load over a minimum to maximum percentile load range (i.e. minimum power to maximum power). The gas turbine is capable of providing power to the load up to the maximum of a first percentile range. It also provides hot exhaust gasses to the steam turbine boiler to make steam for powering the steam turbine.

The steam turbine operates over the entire percentile range and has an associated auxiliary firing means operating over a second percentile range for providing supplementary heat for the steam turbine boiler. This supplementary heat allows steam to be generated at one or more program selected rates whereby the steam turbine in combination with the gas turbine provides power to the load over the entire percentile range.

Control of the system is provided by monitoring power signals representative of total system power and comparing these signals with a set point power demand signal representive of the amount of power to be provided to the load. This comparison results in the generation of a demand or reference signal indicative of a desired rate of fuel or fluid flow to be metered to the auxiliary firing means.

The reference signal controls fuel flow to the gas turbine over the first percentile range and is also compared with a metering signal. The latter signal is also utilized to control the rate of fuel flow to the auxiliary firing means.

The rate of change of the metering signal is program selectable to control the rate of fuel flow in accordance with specified turbine operating parameters or conditions. The rate of fuel flow increases or decreases in accordance with the value of the reference signal until the reference and flow rate signals are equal. When equality of these two signals occurs, the flow rate signal and thus the fuel flow rate become constant. Additionally, specified minimum and maximum values of the flow rate signal control minimum and maximum fuel flow rates to the auxiliary firing means, should the set point power demand signal or the power signals exceed specified values.

In view of the foregoing it is therefore an object of the present invention provide a fluid flow control system having enhanced operating capabilities.

It is a further object to provide means for automatically controlling the rate of change of fuel flow for the auxiliary firing of a steam turbine.

A still further object is to provide apparatus for automatically controlling the auxiliary firing of a steam turbine power generator under all operating conditions.

Another object is to provide automatic digital analog control of the rate of change of fuel flow for auxiliary firing of a steam turbine.

Yet another object is to provide a turbine power generating system capable of program selecting the fuel flow rate for auxiliary firing of a steam turbine.

BRIEF DESCRIPTION OF THE DRAWINGS

The present invention may be more readily described and understood by a reference to the accompanying drawing in which.

DESCRIPTION OF THE PREFERRED EMBODIMENT

Figure 1:
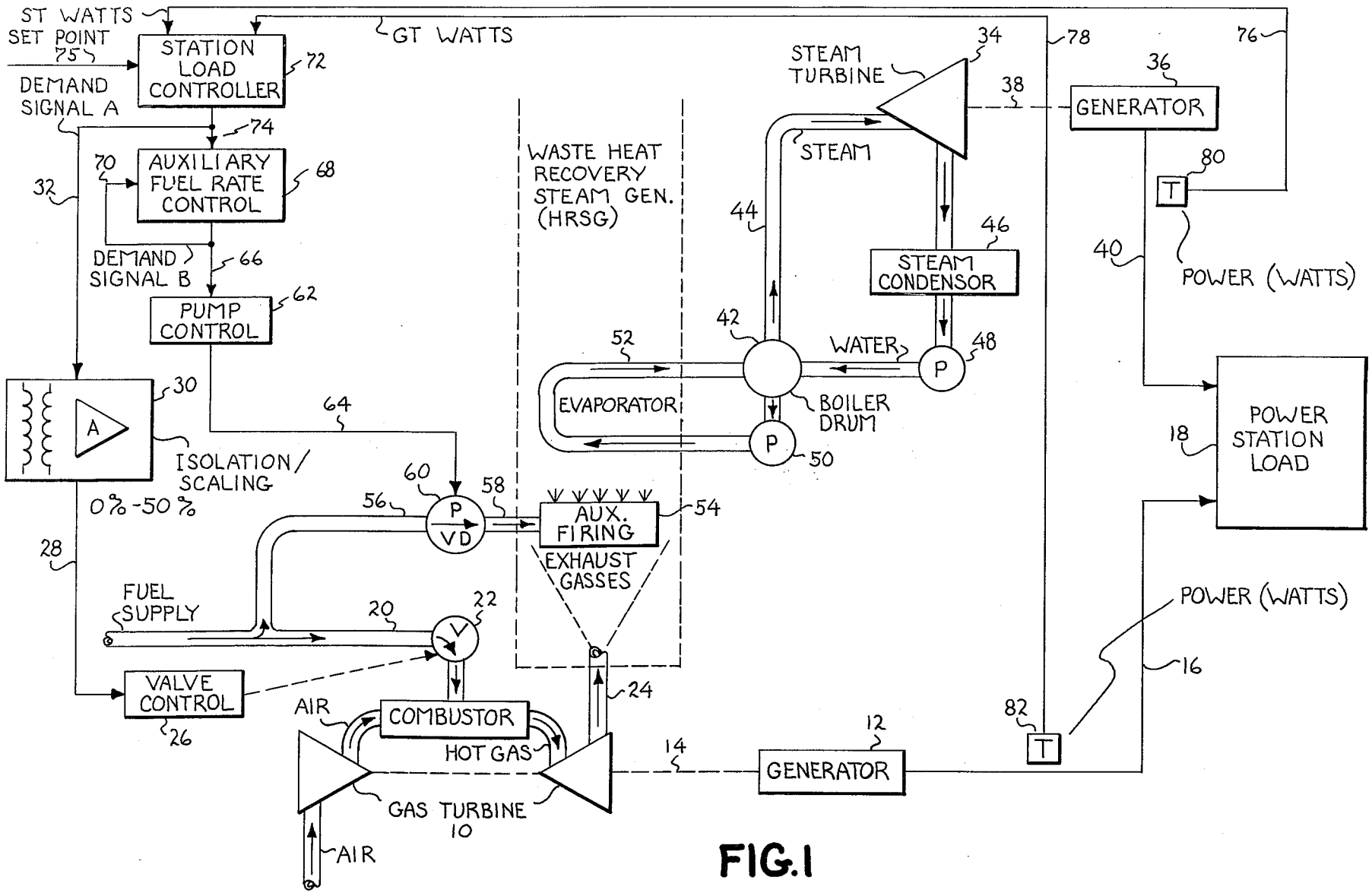
FIG. 1 is a major block diagram of an exemplary turbine powered generating system encompassing the present invention.

Reference is now made to FIG. 1 which illustrates in major block diagram form a turbine powered generating system in accordance with the present invention. The system is of the type comprising a gas turbine 10 and its associated generator 12, the latter being driven from the gas turbine through a mechanical linkage 14. When the gas turbine is in operation, the generator 12 provides output power via one or more conductors 16 to a conventional power station load 18 of the type generally found in industrial and domestic power distribution stations.

The gas turbine 10 is of the conventional type which receives atmospheric air into a compressor wherein that air is fed into a combustor and mixed with fuel from a fuel supply connected to the combustor via a conduit 20 and conventional regulator control valve 22. Heated gasses are exhausted from the combustor into the turbine section of the gas turbine and passed from that section as hot exhaust gasses via an exhaust 24 into a waste heat recovery steam generator identified in FIG. 1 in parenthesis as HRSG. A description of the HRSG will subsequently be given.

The amount of fuel provided to the combustor of the turbine 10 via valve 22 is controlled by a valve control 26 which may be either mechanically or electrically connected to the valve. The valve control 26 is of conventional type utilized in gas turbine control systems and receives an electrical input control signal on a conductor 28 for controlling its output. The valve control output in turn controls valve 22 to meter the proper amount of fuel to the combustor.

The input signal to the valve control 26 is on a conductor 28 from an isolation and scaling circuit 30. The isolation and scaling circuit 30 is represented as an isolation network comprised of an isolation transformer and scaling amplifier of conventional type utilized in turbine powered generating systems. Isolators of this type are frequently used when it is desirable to isolate possible common mode voltage or noise associated with the isolator input signal. The scaling amplifier is adjustable and is utilized to discriminate against the passage of a signal having a predetermined maximum value. It will be noted, as shown in FIG. 1 that the isolation and scaling circuitry 30 operates over an exemplary 0 to 50 percent range. In the present embodiment this percentile range is that percentage of the isolator input signal (equivalent to 0 to 50 percent of the total system load requirements) which is passed to the valve control 22. Thus, it can be seen that the gas turbine will handle a maximum of 50 percent of the power station load. To achieve proper scaling, the amplifier of the isolation and scaling 30 is adjusted so that the ouput signal to the valve control 26 will never exceed a value representative of more than 50 percent of the percentile power station load requirements regardless of the value of the input signal. In this manner the gas turbine 10 will never receive more fuel than is required to drive it to the point whereby generator 12 provides more than 50 percent of the total output power to the power station load 18.

The input signal to the isolation and scaling 30 is provided via a conductor 32 as a Demand Signal A. Demand Signal A varies in value or magnitude from 0 percent (minimum) to 100 percent (maximum) of the power station load requirements. Thus, it can be seen that when the value of Demand Signal A achieves a value greater than 50 percent of the overall percentile range the isolation and scaling 30 discriminates against any value of that signal above 50 percent and prevents the upper 50 percent from affecting the operation of the gas turbine 10.

The systems of FIG. 1 is also comrpised of a conventional steam turbine 34 having its associated generator 36 driven through a suitable mechanical linkage 38. In a similar fashion to generator 12, generator 36 also provides power to the power station load via one or more conductors 40. The steam turbine is of conventional type having an associated boiler or boiler drum 42. Water in the boiler is heated to steam and passed through a conduit 44 to power the turbine 10 The steam is passed through the steam turbine and returned back to the boiler drum via connecting conduits, a steam condenser 46 and a pump 48. In steam condenser 46 the steam is condensed to water and pumped back into the boiler where it is reheated for recirculation as steam back to the steam turbine.

It will also be noted that a second pump 50 is provided to pump water from the boiler drum through evaporator coils 52 for heating in the HRSG. This water in the evaporator coils is subjected to variable heat in the HRSG and returned as steam back to the boiler drum to thus control the amount and rate of steam being generated by the boiler. In the present system, all of the heat for heating the water in the boiler is provided by heat passed over the evaporator coils from the gas turbine exhaust gasses and from the supplementary controlled heat of an auxiliary firing means or burners 54.

The auxiliary firing burners receive fuel at a programmed or selected rate which allows fuel to flow into the auxiliary firing burners at a predetermined rate whereby the water in the evaporator 52 is heated at that rate to thus control the rate of steam generation. It is the rate of change of fuel flow into the auxiliary firing burner of the present invention which is precisely controlled to minimize the stresses imposed on the steam turbine by controlling the steam which drives the turbine.

Input fuel to the auxiliary firing burners 54 is provided via conduits 56 and 58 and a conventional variable drive pump 60. The rate at which fuel is pumped into the auxiliary firing burner 54 is controlled by a metering signal on conductor 64 from a pump control 62. Pump control 62 is of conventional circuitry much like that of valve control 26 utilized in steam and gas turbine controls. The use of a pump control 62 and a variable drive pump 60 as shown in FIG. 1 is an arbitrary selection determined by the system designer. The pump control 62 and the variable drive pump 60 can be replaced by apparatus similar to valve control 26 and valve 22.

A metering or Demand Signal B on a conductor 66 is provided to the pump control 62 from an auxiliary fuel rate control 68. This feedback signal is compared with the previously mentioned Demand Signal A, the latter serving as a reference signal. The Demand Signal B tracks the reference signal in a comparator internal to the fuel rate control to effect control of the Demand Signal B.

Demand Signal A, as well as being provided to the isolation and scaling 30, is also provided to the fuel rate control 68 from a station load controller 72 via a conductor 74. Three input signals, designated as set point on conductor 75, steam turbine watts (ST watts) and gas turbine watts (GT watts) are provided to the station load controller. The ST watts and GT watts signals are provided to controller 72 via conductors 76 and 78 respectively from two power wattage transducers 80 and 82. Transducers 80 and 82 are of conventional types which sense the amount of power being provided on conductors 40 and 16 to the power station load 18. These transducers generate output signals representative of the amount of power being generated by generators 35 and 12. The ST and GT watts signals, through suitable circuitry within the station load controller 72, are summed to generate a single output signal representative of total system watts or power. As will subsequently be described in connection with FIG. 2, this total watts signal is combined in a differential amplifier with the set point signal on conductor 75. The set point signal may be provided either manually by an operator or automatically from other suitable control not shown. The output of the differential amplifier is the Demand Signal A. This signal results from the difference between the total watts and the operator set point signals.

Still referring to FIG. 1, it is significant to note at this time that all of the control circuitry for controlling the operation of the gas turbine 10 is not shown. This has been specifically omitted for simplification of the drawing and particularly since that circuitry is not significant to the operation of the present invention. Normally, however, this control circuitry would be inserted in conductor 28 between the isolation and scaling 30 and the valve control 26 whereby the signal on conductor 28 is combined in that control circuitry with other signals representative of gas turbine conditions to generate the proper output control signal to the valve control 26. Typical circuitry for controlling a gas turbine of the type utilized in the present invention is shown and described in U.S. Pat. No. 3,520,133 to A. Loft et al. entitled "Gas Turbine Control System" and assigned to the assignee of the present invention.

Figure 2:
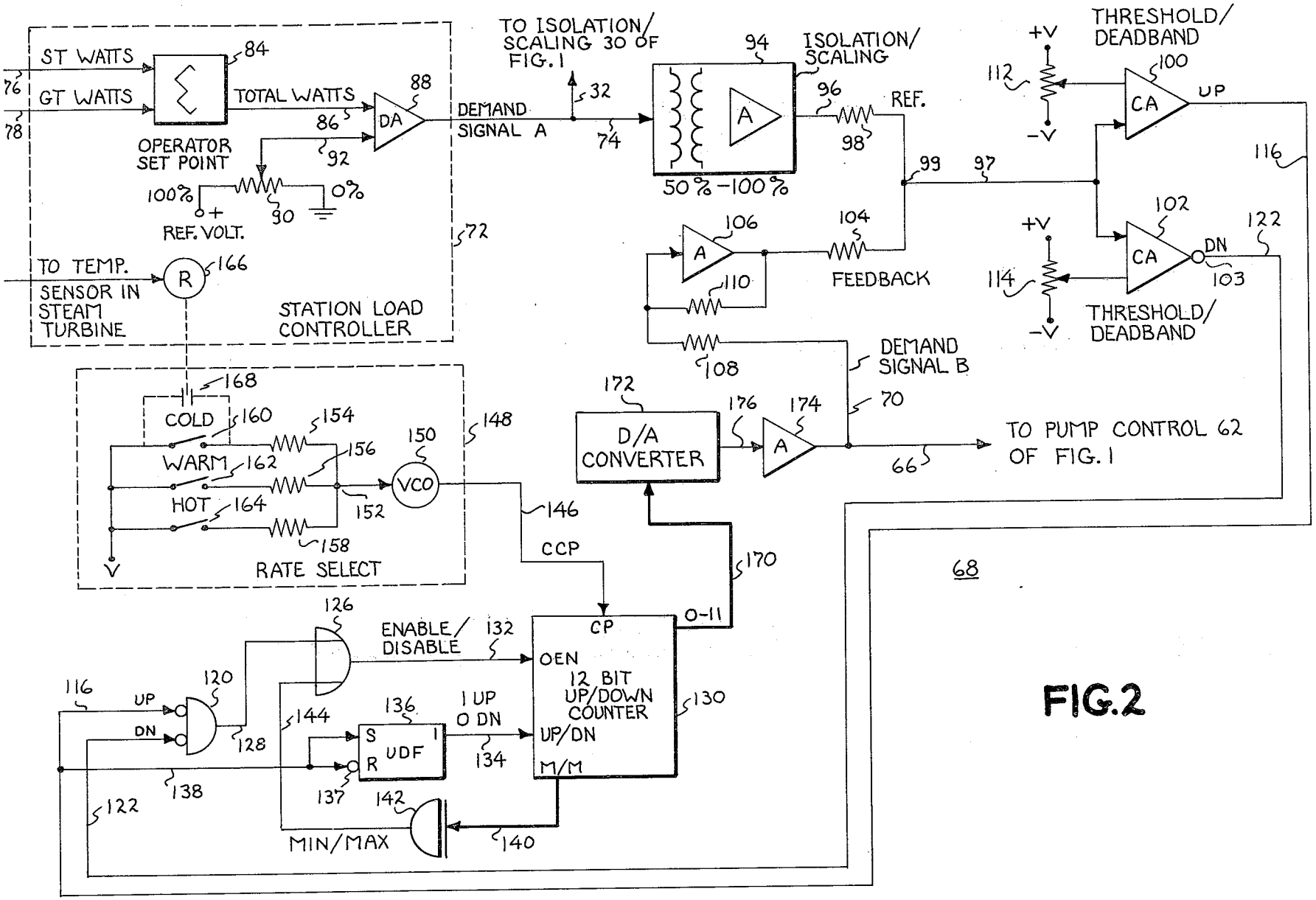
FIG. 2 is a detailed drawing showing circuitry and logic for automatically controlling the rate of fuel flow to an auxiliary firing means of FIG. 1.

Reference is now made to FIG. 2 which illustrates in schematic and block diagram form the station load controller 72 and that circuitry comprising the auxiliary fuel rate control 68. The station load controller 72 is comprised of a summation network 84 which receives the input signals SG watts and GT watts from transducers 80 and 82 respectively of FIG. 1. As previously described, these two signals are proportional to the amount of power being provided to the load 18 by generators 36 and 12. The summation network 84 may be comprised of any number of conventional types of summation amplifiers or transformer devices having resistors connected in series with their secondary windings to provide a summation output signal designated as total watts on a conductor 86.

The total watts signal is provided to a differential and integrating amplifier 88 on conductor 86. A second input to amplifier 88 is from a variable voltage source shown as a potentiometer 90. Potentiometer 90 is connected between a common shown as ground and a reference voltage (REF VOLT.). Potentiometer 90 is adjustable between ground and the reference voltage to provide an operator set point input signal via conductor 92 to the input of the differential amplifier 88. For purposes of illustration and to simplify the drawing of FIG. 2, the potentiometer 90 is shown to be a manually adjustable operator set point input to amplifier 88. However, this input on conductor 92 could also come from a remote control voltage source such as conductor 75 of FIG. 1. This set point input could be provided externally by either a computer or via a telecommunication link for remotely controlling the operation of the system. The purpose of the operator set point is to allow the system operator to adjust potentiometer 90 from a 0 to a 100 percent setting representative of the amount of power (e.g. megawatts) which the two generators 36 and 12 are to provide to the power station load 18. The operator set point signal from potentiometer 90 is compared by amplifier 88 with the total watts signal to generate an output signal (Demand Signal A) resulting from the difference between those two signals and being indicative of a desired rate of fuel flow. As previously described, the Demand Signal A is provided to the isolation and scaling 30 of FIG. 1 on conductor 32. It is this signal which is utilized to drive the valve control 26.

Demand Signal A is also provided on conductor 74 to an isolation and scaling 94 of the fuel rate control 68. The isolation and scaling 94 is shown to include a transformer and scaling amplifier of a similar type as previously described for the isolation and scaling 30 of FIG. 1. The primary difference between the isolation and scaling 94 and that of the isolation and scaling 30 of FIG. 1 is that the former is adjusted to operate from 50% to 100% of the percentile load range of the system. The output of the isolation and scaling 94 is designated as a reference signal (REF) on conductor 96. This reference signal is fed through a resistor 98 via a summation junction 99 and a common conductor 97 as one input to each of two comparator amplifiers 100 and 102. Amplifier 100 is a non-inverting amplifier whereas amplifier 102 is inverting as indicated by the circle 103 on its output. Also connected to the common conductor 97 is a feedback or tracking signal previously described as the metering or Demand Signal B. This feedback signal is provided to juncion 99 via a resistor 104 and a feedback amplifier 106. Amplifier 106 receives its input via conductor 70 and resistor 108 as Demand Signal B. Amplifier 106 is a conventional d.c. or operational amplifier having a normal feedback resistor 110 for controlling the overall gain of the amplifier. The sum of the two currents flowing through resistors 98 and 104 into junction 99 determine the amplitude or value of the signal applied to the inputs of the comparator amplifiers 100 and 102 on conductor 97.

The amplitude of the signal on conductor 97 turns amplifiers 100 and 102 on or off to generate either a binary 1 or a binary 0. Each of the amplifiers 100 and 102 receive a second input from a corresponding threshold/deadband potentiometer shown as 112 and 114 for adjusting the threshold or deadband limits of each amplifier. Potentiometers 112 and 114 are each connected between a negative potential (−V) and a positive potential (+V). Potentiometer 112 is adjusted so that amplifier 100 generates a binary 1 or UP signal whenever the REF signal through resistor 98 exceeds the feedback voltage or current through resistor 104. Contrary to the adjustment of potentiometer 112, potentiometer 114 is adjusted to cause amplifier 102 to generate a binary 1 or DN output signal whenever the feedback signal through resistor 104 is greater than the REF signal through resistor 98. Thus, it can be seen that whenever the voltage on conductor 97 fluctuates between two predetermined values (e.g. +0.4 volts to −0.4 volts), as determined by the settings of potentiometers 112 and 114, the two amplifiers 100 and 102, in a complementary fashion will either conduct or not conduct. It is significant to note that the adjustments of potentiometers 112 and 114 for controlling the threshold turn on and turn off levels of amplifiers 100 and 102 are set close enough together to cause both amplifiers to generate binary 0's simultaneously when the REF and feedback currents are equal (e.g. 0 volts).

The UP signal from amplifier 100 is applied on a conductor 116 as one input to a gating element 120. In a similar fashion the DN signal from amplifier 102 is applied to gate 120 on conductor 122. Still referring to gate 120 (illustrated as a NOR gate), it will be noted that two circles appear on the up and down inputs of that gate. These circles indicate that inversion takes place of the signals applied to that gate. If two binary 0 signals are applied to gate 120 it will be enabled to generate a binary 1 output signal. The output of gate 120 is connected via conductor 128 to a first input of an OR gate 126. The output of OR gate 126 provides an enable/disable output signal to an OEN input terminal of a 12 bit up/down counter 130. The enable/disable signal on conductor 132 is capable of achieving either a binary 1 or a binary 0 state and is utilized to enable and disable the counter 130. To enable counter 130 to count, a binary 0 signal on conductor 132 is applied to the OEN terminal. A binary 1 signal will disable the counter.

The up/down counter 130 is controlled to count either up or down in accordance with a binary 1 UP signal or a binary 0 DN signal applied to an UP/DN input terminal on conductor 134 from an up/down flip-flop (UDF) 136. It will be noted that the 1 UP and 0 DN signals are applied to the counter from the 1 output terminal of the UDF flip-flop. When the UDF flip-flop is in a set state a binary 1 signal (1 UP) will cause the counter to count up. When the flip-flop is in a reset state a binary 0 signal (0DN) on conductor 134 will cause the counter to count down.

The UDF flip-flop 136 is either set or reset in accordance with the state of the UP signal from amplifier 100. When the UP signal is a binary 1 the UDF flip-flop will set by the application of the UP signal to its S or set input terminal. When the UP signal is a binary 0, the UDF flip-flop will reset due to the inversion by inverter 137 connected to the UDF R (reset) terminal.

The up/down counter 130 also contains an output terminal designated M/M for providing at least one output signal on one or more conductors 140 to an AND gate 142. The output M/M from the counter indicates that the counter has achieved either a minimum or a maximum count. The counter contains its own logic for recognizing either a minimum or a maximum count and generating output signals accordingly on conductors 140. Whenever AND gate 142 is enabled its output goes to a binary 1 and provides a binary 1 to a second input of OR gate 126. When OR gate 126 is enabled by a binary 1 MIN/MAX signal on conductor 144 the enable/disable signal 132 will go to a binary 1 disabling counter 130. The purpose of the MIN/MAX detection from the output of counter 130 will become apparent as the description proceeds.

The 12 bit counter 130 is shown as a block diagram in FIG. 2 and comprises all of its own enable up/down control logic and MIN/MAX recognition logic. The details of the counter have not been shown since this counter is a commercially available item and can be found in the "TTL Data Book For Design Engineers" published by Texas Instruments, Inc., Copyright 1973. The counter 130 is actually comprised of three 4 bit counter integrated circuit chips and identified in the data book as type SN 174191.

A rate of change signal, shown as clock input signal CCP is provided to a clock pulse (CP) input terminal of counter 130 via a conductor 146 from a rate select means or circuitry 148. The rate select 148 provides a means of selecting or program controlling the rate of the CCP pulses applied to the counter 130. By controlling the rate of the CCP pulses it is possible to control the rate at which the counter 130 counts. In the embodiment of FIG. 2 this clock pulse rate is determined by the output of a variable frequency voltage controlled oscillator (VCO) 150. The oscillator 150 is a conventional voltage controlled oscillator well known in the art and is shown receiving selected voltage inputs via a common conductor 152. The conductor 152 is connected in common to one end of each of three resistors 154, 156 and 158, each of a different value. The resistor 154 receives a voltage from a voltage source V whenever a cold switch 160 is closed. The value of the resistor 154 determines the voltage level applied to the oscillator 150. The level of the voltage causes the oscillator to provide output pulses at a predetermined rate in accordance with that voltage. In a similar fashion resistors 156 and 158 also receive the input voltage V via warm and hot switches 162 and 164 respectively. As each switch is closed a predetermined voltage (as determined by the values of their corresponding resistors) is applied on conductor 152 to the oscillator causing it to generate output pulses CCP at a rate determined by the value of that voltage.

The switches in the rate select are shown to be manual switches which can be manually operated by a system operator as specified by system operating parameters. For example, when operating the steam turbine in the cold condition, the operator will close the cold switch 160. This will cause the oscillator 150 to generate output pulses, for example at a relatively slow rate, causing the up/down counter to count at that rate. After the steam turbine has operated for a while, and the operator has determined, by reading gages, that the steam turbine parameters have achieved a warm condition he may close the warm switch and open the cold switch. At this time the oscillator 150 will begin to generate pulses at a faster rate. After a sufficient warm up period, the operator may then close the hot switch and open the warm switch causing the oscillator 150 to generate pulses at a still faster or desirable maximum rate.

Still referring to the rate select 148, it will be noted that a relay 166 is shown mechanically connected to a set of associated cold relay contacts 168 which bridge the cold switch 160. The cold contacts 168 are shown in dotted lines to indicate that the cold switch 160 can be replaced by an automatic closure relay contact 168. Contacts 168 are controlled by relay 166 which in turn is controlled from a temperature sensor in the steam turbine not shown. Obviously there could be a relay and a set of contacts for each of the other switches 162 and 164 connected in the same fashion to corresponding temperature or parameter sensors in the steam turbine. Thus, it can be seen that by replacing the switches 160, 162 and 164 with corresponding relays the system can be automatically controlled or programmed to operate the oscillator at rates specified by each of the resistors 154, 156 and 158 when their corresponding relay contacts close. Additionally the cold, warm, and hot voltages or any other combination thereof could be provided to the oscillator 150 from a process computer or controller.

Reference is now made back to the counter 130. Counter 130 also provides a plurality of digital output signals shown as bits 0–11 on conductors 170 to a digital-to-analog (D/A) converter 172. The D/A converter 172 is of conventional type for converting signals representative of a digital value in counter 130 into an analog value for output to an amplifier 174 on conductor 176. Amplifier 174 is a conventional operational amplifier which amplifies the output analog signal from the converter 172 to provide sufficient drive to the pump control 62 of FIG. 1 and to the input of amplifier 106.

Operational Description

It is significant to note again at this time that the primary purpose of the invention is to control the rate of change of fluid or fuel flow to the exemplary auxiliary firing means 54 of FIG. 1 to control the amount of heat presented to the evaporator 52. By controlling this heat, the rate at which the steam in the boiler 42 is generated is controlled. As previously mentioned this controlled rate minimizes those stresses associated with steam turbines.

Figure 3:
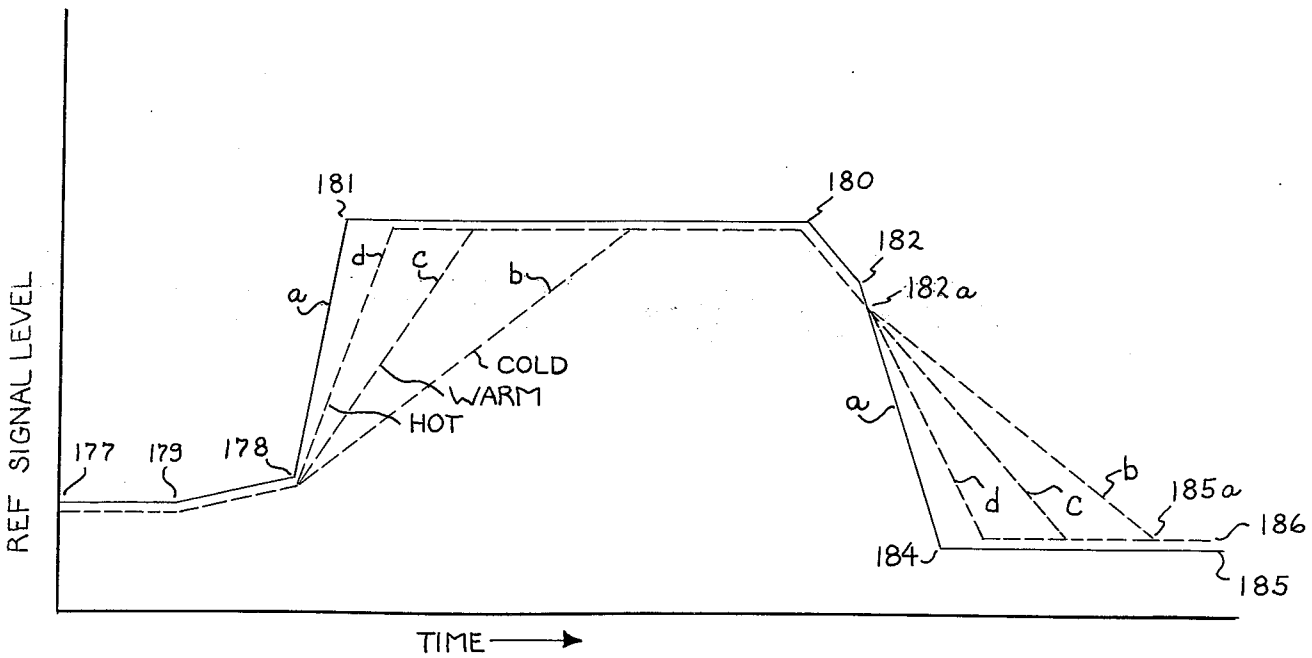
FIG. 3 is a performance chart useful in describing the operation of the invention and shows the operation of the invention under varying operating conditions.

Prior to proceeding further with the operational description it is considered advantageous to describe the basic operation of the invention as related to FIG. 3.

FIG. 3 is an exemplary performance chart or graph showing how the feedback or metering Demand Signal B tracks the reference signal REF. with time. Referring to FIGS. 2 and 3 it can be seen that the REF. signal at the output of the isolation and scaling 94 changes in accordance with the Demand A signal. Typical changes of the REF signal are exemplified by the solid curve *a* of FIG. 3. Dotted line curves *b*, *c* and *d* of FIG. 3 illustrate how the Demand B signal at the output of amplifier 174 of FIG. 2 tracks the REF. signal under various steam turbine operating conditions. Curves *b*, *c* and *d* illustrate this tracking under steam turbine cold, warm and hot conditions. It is significant to note that the Demand B signal increases at a slower or dampened rate than the REF signal when the latter signal makes a rapid change. Also, it will be noted that the Demand Signal B increases at a slower rate when the steam turbine is cold then when it is warm or hot. It is this dampening and variance of the rate of change of the Demand Signal B under various turbine operating conditions with rapid changes in the REF signal which effectively minimize the turbine stresses by precisely controlling the rate of fuel flow to the auxiliary firing means 54 of FIG. 1.

FIG. 3 also shows how the Demand Signal B tracks the REF signal when the latter signal is relatively constant as shown between points 177 and 179 and 184 and 185. Also illustrated between points 178 and 179 and 180 and 182 is how the Demand Signal linearly tracks the REF signal for relatively slow changes in the latter signal. How the Demand Signal B tracks the REF signal will subsequently be described in connection with FIG. 2.

Small or rapid changes can take place in the REF signal with corresponding changes in either the GT or ST watts signals applied to controller 72 or whenever the operator makes a change in the operator set point potentiometer 90. A rapid change in the REF signal will most frequently occur when the operator set point is increased or decreased very quickly over a large range as shown between points 178 and 181 or between points 182 and 184 of FIG. 3.

In the ensuing description, reference will be made to FIGS. 1, 2 and 3. In systems of the type being described, it is customary to first fire up the gas turbine 10 and get that turbine on line whereby generator 12 is providing power to the station load 18. As shown in FIG. 1, with the gas turbine operating, the hot exhaust gasses heat the evaporator 52 to bring the boiler up to steam temperature. Once the boiler temperature is up to proper operating temperature, various control valves, not shown, for operating the steam turbine are opened to provide steam to the turbine. When the steam turbine is first placed in operation it is considered to be in a cold condition (i.e. not up to normal operating temperature).

Let it be assumed that both turbines are now running on line and that the steam turbine is running in the cold condition (switch 160 closed). With both turbines now running, generators 12 and 36 are providing power to the power station load 18. The two transducers 80 and 82 are providing signals ST and GT watts on conductors 76 and 78 to the summation circuit 84. As previously described the output of the summation circuit is a signal representative of total system power being provided to the power station load 18. The total watts signal on conductor 86 is now being provided to the differential amplifier 88 in conjunction with the operator set point signal from potentiometer 90.

When the system is first started up the operator set point is normally set at a relatively low value, such as 5 percent, although it is not mandatory. As a result, the value of the Demand Signal A is relatively small (equal to 5 percent and less than 50 percent). At this time no fuel is being provided to the auxiliary firing means 54. All of the heat for the evaporator 52 is being provided by the gas turbine exhaust. The steam and gas turbine generators are both providing power to the load at this time. As the operator continues to increase the set point from 5 percent to 50 percent the gas and steam turbines will both increase their generator outputs accordingly. When the set point reaches 50 percent (the maximum power output capability of the gas turbine generator) fuel will begin to be metered to the auxiliary firing means 54 to provide more steam for the steam turbine so it can pick up the additional power demand above 50 percent. As previously described, it is the rate of change and the value of the Demand Signal B applied to the pump control 62 (FIG. 1) which controls the rate of fuel flow to the auxiliary firing means 54 via pump 60.

To now understand the operation of the logic and circuitry comprising the auxiliary fuel rate control 68 of FIG. 2 it is desirable to analyze that operation under basically four conditions. They are: (1) when the operator set point is less than 50percent; (2) when the REF and feedback signals at point 99 are both equal; (3) when the REF signal is greater than the feedback signal; and (4) when the feedback signal is greater than the REF signal.

For the first condition let it be assumed that both turbines are running and that the set point (potentiometer 90) is set at some value less than 50 percent. As a result the REF signal from the isolation and scaling 94 will be at its minimum or zero value. Additionally when power is first applied to the circuitry of FIG. 2 the value of the feedback signal is unknown and can be any value from minimum to maximum. This is due to the fact that the counter 130 can take on any count when power is first applied to it, thus causing the Demand Signal B on conductor 70 to take on the value as determined by the A/D converter 172. This is of no significance, however, because the system is self-stabilizing. This is explained as follows.

If it is assumed that the counter 130 contains a minimum count (all binary 0's) the metering signal at the output of amplifier 174 is at its minimum or zero value. Thus, the REF and feedback signals at junction 99 are essentially equal and cancel each other out to provide, for all practical purposes, a zero volt signal to amplifiers 100 and 102. The low valued signal on conductor 97 causes amplifier 100 to be turned off and amplifier 102 to be turned on. Thus, each is generating a binary 0 output signal on associated conductors 116 and 122.

With the UP and DN signals both at binary 0 gate 120 is now enabled applying a binary 1 disable input signal to the OEN terminal of counter 130. Also, the binary 0 UP signal causes the UDF flip-flop 136 to be reset. The counter is also disabled by the binary 1 MIN/MAX signal from now enabled AND gate 142. The counter cannot count until the REF signal increases sufficiently to turn on amplifier 100.

Still considering the first (1) condition let it now be assumed that the counter 130 is at some count other than zero when power is first applied. Under this condition, the feedback signal from amplifier 174 is at a value proportional to the count in counter 130. The feedback signal is now greater than the REF signal. The voltage on conductor 97 is now sufficiently negative to cause the output of amplifier 102 to become a binary 1 and amplifier 100 to become a binary 0 (i.e. both amplifiers turned off).

The binary 1 UP signal disables gate 120 removing the disable signal on conductor 132. Gate 142 is not enabled at this time because the counter is not at minimum or maximum. It will also be noted that the binary 0 UP signal causes the flip-flop UDF 136 to reset enabling the counter to count down.

With the counter now enabled to count down, the clock pulses (CCP) cause the counter to start counting toward zero at the rate determined by the oscillator 150. For each diminishing count of counter 130 the feedback voltage (Demand Signal B) will decrease accordingly. When the feedback voltage equals the REF voltage cancellation occurs as previously described causing the outputs of amplifiers 100 and 102 to both generate a binary 0 output signal (UP and DN). The binary 0 UP and DN signals will disable counter 130 as previously described, thus stopping or holding the Demand Signal B at its minimum or zero value.

Basically condition (2) was just described in (1) above (i.e. the operation of the fuel rate control when the REF and feedback signals are equal at minimum values). Amplifiers 100 and 102 will each generate a binary 0 output when these two signals are equal regardless of their values. This is due to the fact that equal currents at junction 99 always cancel out to provide essentially zero volts to each of the amplifiers.

Consider now condition (3), when the REF signal is greater than the feedback signal. This condition can occur at anytime when the operator increases the set point voltage (potentiometer 90) to a new value above 50 percent and if the counter is at some count causing the feedback signal to be less than the new value. If the set point change is a rapid increase, the REF signal will change as shown in the example of FIG. 3 from point 178 to 181. This increase in the REF signal now exceeds the value of the feedback signal causing amplifiers 100 and 102 to both turn on. Amplifier 100 now generates a binary 1 UP signal and amplifier 102 (due to inversion) generates a binary 0 DN signal.

The binary 1 UP signal prevents gate 120 from being enabled so that counter 130 is enabled and it sets flip-flop UDF 130. With UDF 130 set and 1 UP signal on conductor 134 steers the counter to start counting up in response to the oscillator CCP pulses.

Counter 130 will continue to count up at the rate determined by the oscillator 150 as specified by the closed cold switch 160. It will be recalled at the beginning of the discussion that the cold switch 160 was assumed closed. As counter 130 counts up Demand Signal B on conductors 70 and 66 increases at a much slower or dampened rate than the REF signal. A comparison of the REF signal and the Demand Signal B under these described conditions is illustrated by curves *a* and *b* of FIG. 3. It is the Demand Signal B (curve *b*) which is provided as a metering signal to the pump control 62 (FIG. 1) to control the rate of fuel flow to the auxiliary firing means 54 via pump 60.

Counter 130 will continue to count until it achieves its maximum count or until the feedback signal (Demand Signal B) at junction 90 is equal to the REF signal. When these two signals are equal, cancellation occurs at junction 90 and the counter is inhibited from counting as previously described. However, if counter 130 reaches its maximum count before the feedback signal equals the REF signal the counter is disabled via gates 126 and 142 which are enabled at that maximum count. It can now be seen that the system of the present invention (by virtue of the minimum and maximum count detection) provides programmed limits for controlling the rate of fuel flow to the auxiliary firing means 54.

The last condition to be considered is condition (4). In this latter condition it is assumed that the feedback signal at junction 90 is greater than the REF signal. Referring to FIG. 3 it can be seen that this condition occurs when the REF signal *a* rapidly decreases, for example from point 182 to point 184. With this rapid decrease the signal on conductor 97 goes sufficiently negative (e.g. to −0.4 volts) to cause amplifiers 100 and 102 to generate a binary 0 and a binary 1 respectively.

Gate 120 is disabled due to its complementary UP and DN input signals and flip-flop UDF 136 is now reset by the binary 0 UP signal applied to its R (reset) input terminal. With UDF 136 reset and gate 126 disabled, counter 130 begins to count down in response to the CCP pulses.

The slow rate of decrease of the feedback signal (Demand Signal B) compared to the rapid decrease of the REF signal is shown by curves *a* and *b* of FIG. 3 where curve a decreases from point 182 to 184 and curve *b* (feedback signal) decreases from point 182*a* to point 185*a*. This decreasing change in the Demand Signal B now causes a decrease in the rate of fuel flow to the auxiliary firing means 54 at a rate commensurate with the slope of curve *b* between points 182*a* and 185*a*.

The counter 130 will again be inhibited when it either reaches its minimum count by the enablement of gates 126 and 142 or when the tracking feedback signal becomes equal to the REF signal. In either event, when counter 130 stops counting, Demand Signal B becomes constant as shown between points 185*a* and 186.

One point in connection with the operation of FIG. 2 remains to be explained, and that is how counter 130 is enabled to count when it is at either its minimum or maximum value. From observation of FIG. 2 it would appear that counter 130 is permanently disabled via gates 126 and 142 when the counter is at either its minimum or maximum value. However, logic (not shown) internal to the counter 130 immediately removes the disable signal on conductor 132 in accordance with the following equation which defines that logic:

$$M/M = (\text{CTR MAX} \cdot 1\ \text{UP}) + (\text{CTR MIN} \cdot 0\ \text{DN})$$

In the above equation M/M specifies the output signals (minimum) or maximum count) provided to AND gate 142 on conductor(s) 140. The term CTR MAX specifies the maximum count of the counter (i.e. all binary 1's) and the term CTR MIN specifies the minimum count of the counter (i.e. all binary 0's). The 1 UP and 0 DN terms represent the state of the UDF flip-flop 136 (conductor 134) for controlling the direction of counter 130. During the operation of the invention it is desirable to inhibit the counter when it achieves either its maximum or minimum count. This desireability is obvious when it is realized that the counter, if not inhibited, will merely roll over from its minimum or maximum count and continue to count. This is an undesirable condition, because, when the present fuel flow rate is at either a minimum or maximum it should be kept at that rate until the REF signal calls for either an increase or decrease in fuel flow rate. If the counter is at its maximum count it should be permissible that it count down. Also if it is at its minimum count it should be permissible that it count up. This is obvious from the preceding equation by assuming that the UP signal applied to the UDF flip-flop 136 is a binary 1 which sets the flip-flop. A binary 1 UP signal on conductor 134 now enables the counter to count up. Let it also be assumed that the counter is at a minimum, thus the M/M output signals on conductor 140 are removed (binary 0's) causing AND gate 142 to be disabled. Gate 120 is also disabled, thus both inputs to OR gate 126 are binary 0's. As a result, a binary 0 is applied on conductor 132 to the OEN terminal of counter 130. The counter will now count up at a rate determined by the CCP pulses from oscillator 150. From the above equation it can also be seen that counter 130 will count down from its maximum when the UDF flip-flop 136 is reset by a binary 0 UP signal on conductor 116.

The operation of the invention has just been described illustrating how the tracking or metering signal (Demand Signal B) follows the REF signal and controls the fuel flow rate to the auxiliary firing means 54 when the steam turbine is in a cold operating condition. The operation of the system is the same as previously described when the steam turbine is in the warm or hot condition. The only difference is that the feedback signal tracks the REF signal at a different rate for these other selected conditions. For example, if switch 162 is closed oscillator 150 will generate pulses at a more rapid rate than when the cold switch 160 is closed. This faster count rate causes the feedback signal to increase or decrease at a faster rate as illustrated by curve *c* of FIG. 3. In a similar manner, if the cold and warm switches 160 and 162 are open and the hot switch 164 is closed, oscillator 150 provides pulses at a much faster rate to counter 130. Curve d of FIG. 3 illustrates how the metering signal (Demand Switch B) increases or decreases at a much faster rate to control the fuel flow rate to the auxiliary firing means 54. The reason that fuel can be provided to the auxiliary firing means at progressively higher rates with increasing turbine temperature is because larger and faster steam pressures have less stressing affects on the turbine at higher operating temperatures.

In summary it can now be seen how the rate of fuel flow to an auxiliary firing means of a steam turbine is automatically controlled by programming various pulse rates to a counter, the outputs of which control a digital-to-analog converter to generate a metering signal at a rate determined by the counter rate. This programmed rate is effected in the illustrated embodiment in exemplary form by three switches showing cold, warm and hot steam turbine operating parameters or conditions. However, the programmed rate can also be automatically provided as illustrated in FIG. 2 by temperature sensors in the steam turbine controlling relay contacts which operate in conjunction with or replace those cold, warm and hot switches. Further, these switches may also be replaced by logic elements, such as flip-flops or logic gates in communication with a computer which controls the system.

The oscillator 150 of the rate select 148 of FIG. 2 is merely one exemplary means of controlling the programmed rate of pulses applied to the counter 130. There are many other types of oscillators which may be used to generate these programmed pulses. For example, a standard, free-running multivibrator designed to operate at some predetermined nominal frequency and having switchable RC components connected to its inputs and/or outputs for controlling the oscillator frequency could be employed.

While the principles of the invention have now been made clear in an illustrative embodiment, there will be immediately obvious to those skilled in the art, many modifications of structure, arrangement, the elements, materials, and components used in the practice of the invention and otherwise, which are particularly adapted for specific environments and operating requirements without departing from those principles. The appended claims are, therefore, intended to cover and embrace any such modifications within the limits only of the true spirit and scope of the invention.

What is claimed is:

1. Apparatus for controlling the rate of fuel flow for auxiliary firing of a steam turbine power generating system comprising:

a. auxiliary firing means for receiving combustible fuel at a metered rate for heating a steam boiler of said turbine;

b. means for metering the rate of fuel flow to said auxiliary firing means in response to a metering signal provided thereto;

c. load control means for receiving power signals representative of the amount of power being provided to said load, said load control means including means for providing a variable set point signal indicative of the amount of power to be provided to said load and generating an output demand signal representative of the difference between said power and set point signals and further being indicative of a desired rate of fuel flow;

d. comparison means responsive to said demand signal and to said metering signal to provide an output signal when a difference exists therebetween;

e. control signal generating means for generating said metering signal and for varying the value thereof in response to said comparison means output signal, said control signal generating means further responsive to a rate of change signal supplied thereto to control the rate at which said metering signal changes; and f. means for providing said rate of change signal to said control signal generating means.

2. The invention as recited in claim 1 wherein said metering signal is an analog signal and varies in accordance with changes in said demand signal to control desired increased and decreased fluid flow rate limits.

3. The invention as recited in claim 1 wherein said control signal generating means includes means for limiting the value of said metering signal when the difference between said demand signal and said metering signal is of a specified value.

4. The invention as recited in claim 1 wherein said means for providing said rate of change signal includes means for selectively changing the value of said rate of change signal to change the rate of change of said metering signal.

5. The invention as recited in claim 4 wherein said means for selectively changing the value of said rate of change signal comprises a variable frequency oscillator responsive to signals from said steam turbine representative of operating parameters therein to program said oscillator to operate at predetermined frequencies.

6. An apparatus for automatically controlling the rate of change of a metering signal for controlling the rate of fuel flow for a boiler serving to generate steam for powering a steam turbine generator providing electrical power to a load comprising:

a. auxiliary heating means for providing heat to said boiler, said means including means in communication therewith for metering the rate of fuel flow thereto in response to said metering signal;

b. means for generating said metering signal including;

1. comparison means responsive to a demand signal indicative of a desired rate of fuel flow and to said metering signal to provide an output signal when a difference exists therebetween, 2. signal generating means for generating said metering signal and for varying the value thereof in response to said comparison means output control signal, said signal generating means further responsive to a rate of change signal supplied thereto to control the rate at which said metering signal changes, and 3. rate select means for providing a rate of change signal at selected rates to said signal generating means to automatically control the rate of change of said metering control signal; and c. load control means including means for providing a set point signal representative of a desired amount of power to be provided to said load, said control means further including means for establishing the difference between said set point signal and a power signal representative of the amount of power being provided to said load to generate said demand signal.

7. The invention as recited in claim 6 wherein said metering signal is an analog signal and varies in accordance with changes in said demand signal to control desired increased and decreased fluid flow rate limits.

8. The invention as recited in claim 6 wherein said signal generating means includes means for limiting the value of said metering signal when the difference between said demand signal and said metering signal is of a specified value.

9. The invention as recited in claim 6 wherein said rate select means comprises a variable frequency oscillator responsive to signals from said steam turbine representative of operating parameters therein to program said oscillator to operate at predetermined frequencies.

10. In a power generating system of the type including a gas turbine power generator for providing hot exhaust gasses to a steam boiler for powering a steam turbine power generator an improved fuel flow apparatus for controlling the rate of fuel flow for auxiliary firing of said steam turbine to control the power provided to a load by said generators, comprising:

a. an auxiliary firing means disposed in the path of the gas turbine exhaust gasses for providing supplementary heat to said boiler in accordance with the rate of fuel metered thereto;

b. metering means for metering the rate of fuel to said auxiliary firing means in response to a metering signal provided to said metering means;

c. load control means to receiving power signals representative of the total amount of power being provided to said load by said generators, said load control means including means for providing a set point signal indicative of the amount of power to be provided to said load and generating an output demand signal representative of the difference between the power signals and the set point signal and further being indicative of a desired rate of fuel flow;

d. a comparator for comparing the values of said demand signal and said metering signal and generating an output signal when a difference exists therebetween;

e. control signal generating means for generating said metering signal and for varying the value thereof in response to said comparison means output signal, said control signal generating means further responsive to a rate of change signal supplied thereto to control the rate at which said metering signal changes; and f. rate select means for providing said rate of change signal to said control signal generating means, said rate select means responsive to operating signals representative of specified steam turbine operating parameters to effect changes in the rate of change signal to automatically control the rate of change of said metering signal with changes in said operating parameters.

11. The invention as recited in claim 10 wherein said metering signal is an analog signal and varies in accordance with changes in said demand signal to control desired increased and decreased fluid flow rate limits.

12. The invention as recited in claim 10 wherein said control signal generating means includes means for limiting the value of said metering signal when the difference between said demand signal and said metering signal is of a specified value.

13. The invention as recited in claim 10 wherein said rate select means comprises a variable frequency oscillator for generating said rate of change signal and means for selectively providing said operating signals to said oscillator to effect changes in the operating frequency thereof.

14. In a power generating system of the type including a gas turbine power generator for providing hot exhaust gasses to a steam boiler for powering a steam turbine power generator, an improved fuel flow apparatus for controlling the rate of fuel flow for auxiliary firing of said steam turbine for controlling the power provided to a load by said generators, comprising:

a. an auxiliary firing means disposed in the path of the gas turbine exhaust gasses for providing supplementary heat to said boiler in accordance with the rate of fuel metered thereto;

b. means for metering the rate of fuel to said auxiliary firing means in response to a metering signal provided thereto;

c. load control means for receiving power signals representative of the total amount of power being provided to said load by said generators, said load control means including means for providing a set point signal having settable values ranging over a minimum to maximum percentile range indicative of the percentage of power to be provided to said load and generating an output demand signal representative of the difference between the power and set point signals and having a value indicative of a desired rate of fuel flow for a desired percentile setting of said set point signal;

d. circuit means for passing said demand signal only when said demand signal achieves a predetermined value corresponding to a desired percentile setting of said set point signal;

e. a comparator in communication with said circuit means for comparing the values of said demand signal and said metering signal and generating an output signal when a difference exists therebetween;

f. control signal generating means for generating said metering signal and for varying the value thereof in response to said comparison means output signal, said control signal generating means further responsive to a rate of change signal supplied thereto to control the rate at which said metering signal changes; and g. rate select means for providing said rate of change signal to said control signal generating means, said select means responsive to operating signals representative of specified steam turbine operating parameters to effect changes in the rate of change signal to automatically control the rate of change of said metering signal with changes in said operating parameters.

* * * * *